US007571498B2

(12) United States Patent
Jewell et al.

(10) Patent No.: US 7,571,498 B2
(45) Date of Patent: Aug. 11, 2009

(54) PATIENT TRANSFER DEVICE

(76) Inventors: William Jewell, 2240 Shelter Island Dr., Slip A202, San Diego, CA (US) 92106; Robert G. Godette, 607 Bent Oak Trail, Greenwood, AR (US) 72936; Vincent L. Ramik, 4966 Sabra La., Annandale, VA (US) 22003

( * ) Notice: Subject to any disclaimer, the term of this patent is extended or adjusted under 35 U.S.C. 154(b) by 0 days.

(21) Appl. No.: 12/007,614

(22) Filed: Jan. 14, 2008

(65) Prior Publication Data

US 2009/0178193 A1 Jul. 16, 2009

(51) Int. Cl.
*A61G 7/08* (2006.01)

(52) U.S. Cl. ..... 5/81.1 HS; 5/81.1 R

(58) Field of Classification Search ..... 5/81.1 HS, 5/81.1 R, 83.1–89.1, 81.1 C, 81.1 T
See application file for complete search history.

(56) References Cited

U.S. PATENT DOCUMENTS 1,977,944 A * 10/1934 Haskett ..... 5/84.1
3,750,199 A * 8/1973 Spivey ..... 5/83.1
3,786,523 A * 1/1974 Sele ..... 5/87.1
3,810,263 A * 5/1974 Taylor et al. ..... 5/81.1 C
4,397,051 A * 8/1983 Wheeler ..... 5/84.1
4,484,366 A * 11/1984 Koontz ..... 5/83.1
4,644,595 A * 2/1987 Daniel ..... 5/83.1
4,924,538 A * 5/1990 Kume ..... 5/81.1 C
4,970,738 A * 11/1990 Cole ..... 5/81.1 C
5,054,136 A * 10/1991 Inagaki ..... 4/546
5,539,941 A * 7/1996 Fuller ..... 5/85.1
5,608,929 A * 3/1997 Crane ..... 5/81.1 R
5,697,109 A 12/1997 Hodgetts
5,819,339 A 10/1998 Hodgetts
5,901,388 A * 5/1999 Cowan ..... 5/81.1 HS
5,937,456 A * 8/1999 Norris ..... 5/88.1
5,996,144 A 12/1999 Hodgetts
6,289,533 B1 9/2001 Hodgetts
6,507,963 B2 1/2003 Hodgetts
6,615,423 B2 * 9/2003 Sverdlik et al. ..... 5/81.1 C
6,629,323 B2 * 10/2003 Sverdlik et al. ..... 5/81.1 C
7,003,819 B2 * 2/2006 Weigand ..... 5/81.1 HS
7,114,203 B2 * 10/2006 Lloyd et al. ..... 5/81.1 HS
7,337,478 B1 * 3/2008 Lake ..... 5/81.1 C
2002/0083521 A1 * 7/2002 Sverdlik et al. ..... 5/81.1 R
2002/0083522 A1 * 7/2002 Sverdlik et al. ..... 5/81.1 R
2003/0110559 A1 * 6/2003 Weigand ..... 5/81.1 R
2005/0150045 A1 * 7/2005 Lloyd et al. ..... 5/81.1 HS

* cited by examiner

*Primary Examiner*—Robert G Santos
(74) *Attorney, Agent, or Firm*—Diller, Ramik & Wight

(57) ABSTRACT

A transfer device transfers an individual from a bed to an adjacent support surface or vice versa and includes a mobile unit defined by a base and an upstanding structure having lower and upper end portions respectively adjacent to and remote from the base. A lower drive pulley and an upper idler pulley are located respectively adjacent to and remote from the base. A motor rotates the lower drive pulleys to wind thereupon a cable at least partially entrained upon the upper idler pulley. Clamps releasably connect the cable to a slide interposed between an individual and a bed or an adjacent support surface upon which an individual is reposed whereby upon operation of the motor, the slide with an individual thereon is pulled from a bed to an associated adjacent support surface or vice versa.

15 Claims, 2 Drawing Sheets

PATIENT TRANSFER DEVICE

BACKGROUND OF THE INVENTION

The present invention relates to solving ongoing and persistent problems encountered by care-givers when transferring a bed-ridden person from his/her bed to and from another support, such as a gurney, a bath/toilet-type platform, etc., or vice versa. The effort required by a care-giver to physically move a bed-ridden person is substantial and many times results in injury, particularly lower back injury, to the care-giver. Elderly, weak and/or essentially immobile persons who are being treated in hospitals or reside in high maintenance nursing homes are continually transferred between a bed and a gurney or a bed and a wheelchair for a multitude of purposes, such as treatment in operating theaters, therapy rooms, x-ray rooms, etc. Absent effective mechanical assistance, as is presently the case, a care-giver must necessarily physically lift, slide and/or carry the bed-ridden person from his/her bed to and from a gurney, a wheelchair, a toilet chair, a shower chair or some other type of bathroom function device which is highly strenuous. Equally strenuous, particularly with relatively heavy patients, is the seemingly simple task of moving a patient horizontally between two supporting surfaces at substantially identical levels, such as an adjacent bed and gurney. An immobile person lacking physical strength is dead weight and, whether pushed or pulled, many care-givers/attendants barely have enough strength to move such a person. Equally dangerous is the application of physical pushing and/or pulling forces to the bed-ridden person which can, in and of itself, cause physical pain and/or damage, particularly when the bed-ridden person is old, may have brittle bones, etc. Therefore, the necessity of a transfer device which is both care-giver and patient friendly is extremely desirable, particularly if made available to hospitals, nursing homes and the like at a reasonable price.

Mechanical transfer devices for transferring bed-ridden persons are available to care-givers but, for the most part, these require considerable strength to manually operate the transfer device. At the very least handles and/or levers must be manipulated to elevate a bed-ridden person and thereafter considerable strength is required to push and/or pull the bed-ridden person, while elevated, to a particular location, such as swinging the bed-ridden person above a wheelchair, a toilet chair, a gurney or the like. One such transfer device is disclosed in a family of patents in the name of Graham L. Hodgetts and assigned to Barton Medical Corporation of Austin, Tex., namely, U.S. Pat. Nos. 5,697,109; 5,819,339; 5,996,144; 6,289,533 and 6,507,963. All of the latter patents disclose a patient transfer device for transferring a patient from a bed to a gurney or from the gurney to the bed utilizing a conveyor attached to both the bed and the gurney. Each conveyor is relatively complex and necessitates being welded to the gurney and/or to the bed frame or being otherwise fastened thereto. A bed sheet is attached to a roller of the conveyor, but as opposed to a standard bed sheet, the bed sheet is necessarily at least twice the width of the bed to enable a patient lying upon one half of the bed sheet to be pulled from the bed or the gurney by rotating the roller, to which the bed sheet is attached, by an associated handle. An obvious disadvantage of this patient transfer device is the necessity of either securing a conveyor to every bed or to every gurney, which is extremely expensive and obviously still involves physical strength to rotate the handle and pull the patient to or from the bed/gurney. The latter patents recognize the seriousness of the problem presented to the health-care industry, but the patient transfer device of the latter patents is at best an extremely inadequate effort aimed toward a solution of the problem at a high cost per patient transfer device.

BRIEF SUMMARY OF THE INVENTION

In accordance with the present invention, a transfer device for moving a bed-ridden patient to and from a bed and/or a gurney or the like includes a self-sustained mobile unit defined by a platform or base mounted on wheels or castors which carries an upstanding structure, preferably in the form of a pair of vertical supports, each having an upper and a lower end carrying respective idler and drive pulleys. Flexible cables are entrained about the pulleys and upper ends of the cables are connected to a pull bar which is in turn connected by attachment clips to a slide sheet which can be a conventional bed sheet but preferably is a sheet of material having an extremely low coefficient of friction at least upon a lower surface thereof which slides upon/across a bed or gurney mattress, a gurney upper support surface, or the like. A lower end of each of the cables is connected to a driven shaft which is in turn driven by a reversible drive motor and a reduction gearing to impart sufficient power to pull the slide sheet and the patient thereupon readily easily from a bed to a gurney or vice versa absent any physical effort on the part of the care-giver/attendant.

The vertical supports are located toward an end of the base or platform remote from a forward end thereof which is located a considerable distance beneath a gurney, for example, onto which a patient is to be moved from an adjacent bed. The vertical supports include pads which bear against the gurney, and as the patient is being slid from the bed to the gurney, any turning moment which might otherwise tend to tilt or cock the transfer device is resisted by the location of the forward end of the platform well beneath the gurney and the contact between the gurney and the vertical supports. This assures that the driving force of the electric motor operating through the reduction gearing and imparted to the slide sheet is efficiently utilized as a pulling force, as opposed to a moment-creating force. Moment-creating forces are also reduced by constructing the vertical supports so as to be vertically adjustable to generate pulling forces applied to the slide sheet which are substantially horizontal and preferably slightly upwardly inclined to the horizontal to maximize the pulling forces applied to the slide sheet and minimize the creation of turning moment forces.

Conventional clamping mechanisms may be associated with the vertical supports for clamping the same to the bed/gurney, etc. to assure efficient patient transfer operations, as might be required if a patient is relatively heavy (200-300 pounds).

A control system for operating the reversing motor preferably includes a hand-held remote control unit provided with appropriate on/off and directional switches and a switch to control a solenoid for engaging a clutch to impart desired directional rotation to the lower driven pulleys which are in turn connected to a single lower driven shaft. Override/safety proximity switches are also utilized to preclude unintended transfer motion of the slide sheet to thereby prevent patient/caretaker injury.

With the above and other objects in view that will hereinafter appear, the nature of the invention will be more clearly understood by reference to the following detailed description, the appended claims and the several views illustrated in the accompanying drawings.

DETAILED DESCRIPTION OF THE INVENTION

Figure 1:
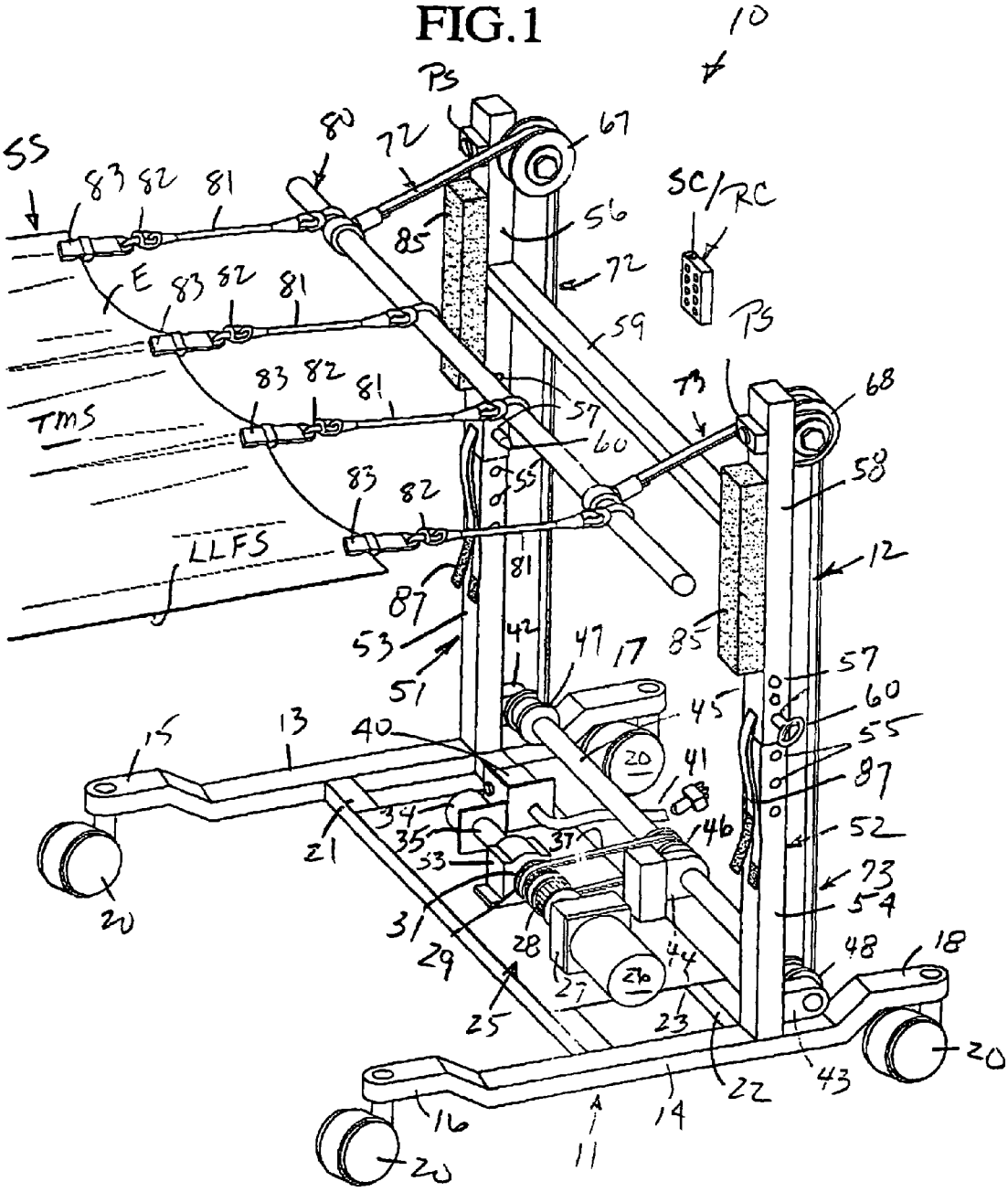
FIG. 1 is a fragmentary perspective view of a novel patient transfer device of the present invention, and illustrates a base carrying at a rear end portion thereof a pair of adjustable vertical supports which in turn carry idler pulleys at upper ends about which are entrained pull cables connected to a pull bar which is in turn connected to a slide sheet upon which a patient lies incident to the performance of a patient transfer operation through the energization of an associated reversible electric motor, reduction gearing, a clutch and a belt drive for rotating a pair of driven pulleys to which the pull cables are connected.

A novel patient transfer device constructed in accordance with this invention is illustrated in FIG. 1 of the drawings and is generally designated by the reference numeral 10.

The patient transfer device 10 is adapted to transfer an individual, patient, bed-ridden person P (FIGS. 2 through 4) or the like from a conventional bed B to a gurney G or vice versa in a manner to be described more fully hereinafter.

The patient transfer device 10 includes a mobile unit defined by platform or a base 11 and an upstanding vertical structure 12.

The base 11 is substantially elongated and includes a pair of substantially parallel high strength steel longitudinal tubes 13, 14 having upwardly offset forward ends or end portions 15, 16 and similar upwardly offset rear ends or end portions 17, 18, respectively. Lockable/unlockable castors or wheels 20 of a conventional construction are conventionally attached to the forward end portions 15, 16 and the rear end portions 17, 18 of the base 11. A pair of high strength steel transverse tubes 21, 22 (FIG. 1) are in parallel spaced relationship to each other and opposite ends (unnumbered) are welded to the longitudinal tubes 13, 14. A steel plate 23 bridges the transverse tubes 21, 22 and is welded thereto.

The plate 23 provides a support for a number of drive components suitably conventionally secured thereto including a drive mechanism or drive means 25 (FIG. 1) defined by an electric reversible motor 26 having an output shaft (not shown) connected to reduction gearing (not shown) located in a conventional step-down gear box 27 having an output shaft (not shown) connected to a conventional clutch defined by clutch bodies 28, 29 having clutch faces (unnumbered) in opposing relationship to each other. The clutch body 29 carries a toothed drive gear 31 carried by a shaft (not shown) supported for rotation in a conventional bearing (not shown) in one or more bearing supports 33, only one of which is shown, carried by the platform 23. A conventional solenoid 34 selectively reciprocates a shaft or plunger 35 axially opposing the shaft (not shown) connected to the clutch body 29 to move the same into and out of engagement with the clutch body 28 to respectively rotate and terminate rotation of the toothed drive gear or sprocket 31 about which is entrained a high strength plastic toothed drive belt or chain 37. A housing 40 carried by the platform 23 is supplied 115 volt A/C power input via a power cord 41 which can be connected to a conventional electrical outlet. The 115 volt A/C input controls the electric motor 26 via a hand wired push-button switch control SC or a remote control RC and an associated transformer (not shown) steps-down the 115 volt A/C to 24 volt D/C to operate the solenoid 34 and associated relays and switches which will be described hereinafter.

The upstanding vertical structure 12 includes a pair of substantially parallel vertical telescopic tubes 51, 52 defined by respective lower inner tubes 53, 54 each having pairs of vertically spaced aligned apertures 55 and outer upper tubes 56, 58, respectively. Each of the outer upper tubes 56, 58 includes pairs of vertically spaced openings 57 which can be selectively aligned with the openings 55 for receipt therein of an associated pin 60 to maintain the telescopic tubes 51, 52 at any one of a plurality of different vertical heights. Lower end portions (unnumbered) of the lower inner tubes 53, 54 are welded to the respective longitudinal tubes 13, 14 of the base 11 and carry at lower ends thereof journal blocks 42, 43 housing conventional bearings. A central bearing block 44 carrying a bearing is connected to the plate 23. A driven shaft 45 carries a toothed gear or sprocket 46 about which is entrained the toothed drive belt or chain 37. Opposite ends of the driven shaft 45 are journaled in the bearings of the journal blocks 42, 43 and 46, and inboard of each bearing or journal block 42, 43 are lower driven pulleys 47, 48, respectively, keyed to the driven shaft 45.

Upper idler pulleys 67, 68 are conventionally secured for free rotation adjacent upper ends (unnumbered) of the respective upper tubular supports 56, 58, respectively, which are secured to each other by a steel tubular transverse brace 59 welded thereto.

Means in the form of elongated elements, such as relatively strong nylon ropes or cables 72, 73 are connected to the lower drive pulleys 47, 48, respectively, and are partially entrained about the respective upper idler pulleys 67, 68. Upper terminal ends (unnumbered) of the respective cables or ropes 72, 73 are connected to a pull bar 80 to which is also connected four identical short resilient elongated members, such as nylon ropes or cables 81 to ends of which are attached a conventional universal joint or connector 82 and a conventional clamp 83 for gripping an edge E of a slide sheet SS which may be a conventional bed sheet but is preferably a sheet of a two-ply construction including an upper textile material surface TMS, such as cotton, and a lower low friction surface LLFS (polymeric/copolymeric material, Teflon®, for example).

Identical elongated cushions or pads 85 are adhesively bonded to each of the upper tubes 56, 58, and each of the upper tubes 56, 58 also carries conventional clamping means 87, such as conventional Velcro® straps.

The patient transfer device 10 preferably is enclosed in a housing (not shown) which precludes access to most of the moving parts to prevent damage thereto and/or damage/harm/injury to patients and/or attendants. For example, the pulleys 67, 68; 47, 48 and the runs of the pulley belts 72, 73 therebetween are entirely enclosed, as is the entirety of the shaft 45, all of the components resting upon the plate 23, and the driven belt or chain 37. Preferably, a vertically upstanding housing portion covering the lower ends of the belts 72, 73 is rigidly secured to the base 11 while upper housing portions are telescopic relative thereto and include access regions for accessing the openings/holes 55, 57 and manipulating the pin 60 associated therewith. Therefore, the only powered components exposed beyond the housing are the upper reaches of the pulley belt 72, 73, the pull bar 80, the ropes 81, the universal joints 82 and the clamps 83.

Patient Transfer Device Operation

Figure 2:
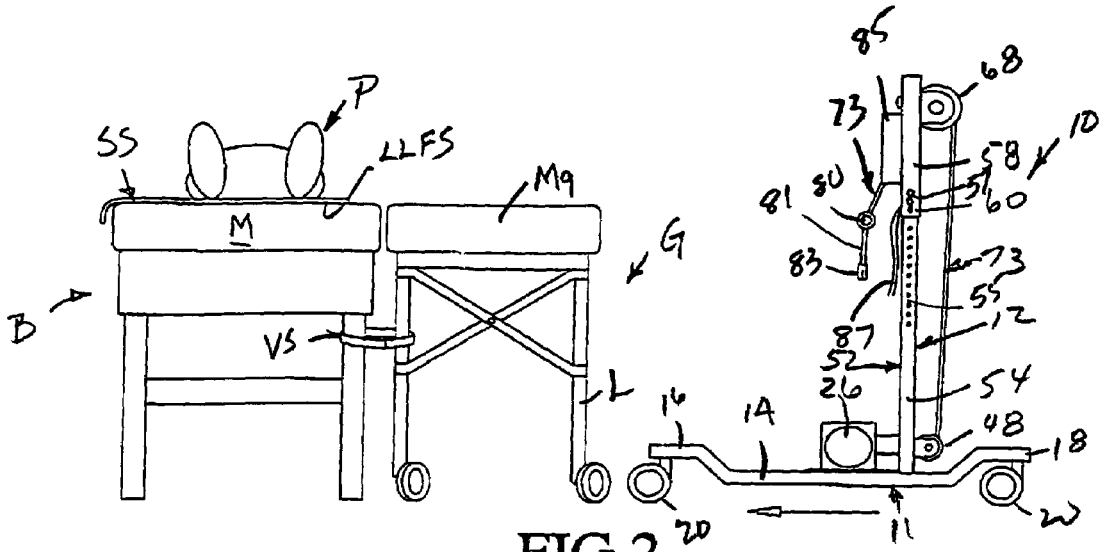
FIG. 2 is a side elevational view of the patient transfer device, and illustrates the same associated with a bed upon which rests the slide sheet, a patient upon the slide sheet, a gurney and the patient transfer device incident to being moved to the position shown in FIG. 3.

Reference is first made to FIG. 2 of the drawings which illustrates the patient or bed-ridden person P lying upon a conventional sheet or preferably the slide sheet SS of the present invention which is readily and easily positioned between the patient P and an upper surface of a conventional sheet (unnumbered) covering a mattress M of the bed B. The slide sheet SS is placed beneath the patient by a care-giver/attendant rolling the patient P from one side to the other while appropriately folding, unfolding and/or manipulating the slide sheet SS in a conventional manner which is relatively effortless, particularly as compared to pulling and/or lifting and transporting the patient P to the gurney G. The gurney G is positioned adjacent the bed B and, if desired, may be at least temporarily secured thereto by conventional Velcro® straps VS. The patient transfer device 10 is then rolled from the position shown in FIG. 2 to the position shown in FIG. 3 after which the support structure 12 can be vertically adjusted utilizing the pairs of openings 55, 57 and the pins 60 to position the cushions 85 against a mattress Mg of the gurney G. The Velcro® straps 87 may then be secured to legs L of the gurney and the clamps 83 are secured to the edge E (FIG. 1) of the slide sheet SS. Since the solenoid 34 (FIG. 1) is not energized, the clutch 28, 29 is not engaged and the care-giver can grasp the pull bar 57 and easily pull the same from the position shown in FIG. 2 to the position shown in FIG. 3 to unwind the nylon cables 72, 73 from the drive pulleys 47, 48 incident to applying the clamps 83 to the edge E of the slide sheet SS. By depressing the correct power/direction of rotation/solenoid buttons of the hard wired push-button switch, control SC or remote control RC, the motor 26 is energized and the reduction gearing 27 is properly rotated to impart rotation to the clutch body 28. The energized solenoid in the solenoid housing 34 axially shifts the clutch body 29 into driven engagement with the rotating clutch body 28. The drive gear 31 imparts drive motion to the toothed belt 37 and rotation to the shaft 45 via the toothed pulley 46. The drive pulleys 47, 48 rotate and wind thereon the nylon ropes 72, 73 pulling the same downwardly relatively slowly but powerfully due to the reduction gearing 27. The relatively high pulling forces are transferred via the pull bar 80 and the nylon ropes 81, the universal joints 82 and the clamps 83 to the slide sheet SS which progressively forcefully but slowly pulls the slide sheet SS and the patient P thereupon from the position shown in FIG. 3 to the position shown in FIG. 4 and slightly beyond the latter until the patient is located centrally upon the gurney mattress Mg. A proximity switch Ps (FIGS. 1 and 4) is associated with the upper end of each upper tube 56, 58 for engagement by the pull bar 80 to cut power to the motor 26 should the care-giver/attendant fail to appropriately de-energize the motor 26 and/or the solenoid 34 through the remote control RC. The clamps 83 are disconnected from the edge E of the slide sheet SS. The gurney G and the patient transfer mechanism 10 are disconnected from the bed B and the gurney G, respectively, by undoing the respective Velcro® straps VS and 87. The patient P can then be transported, as need be, by the gurney G.

Figure 3:
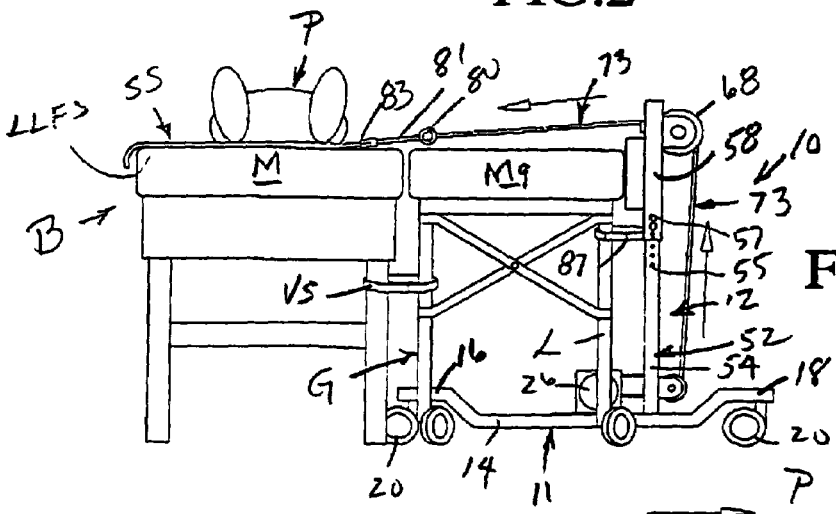
FIG. 3 is a side elevational view, and illustrates the patient transfer device positioned incident to patient transfer with transfer bar clamps connected to an edge of the slide sheet.
Figure 4:
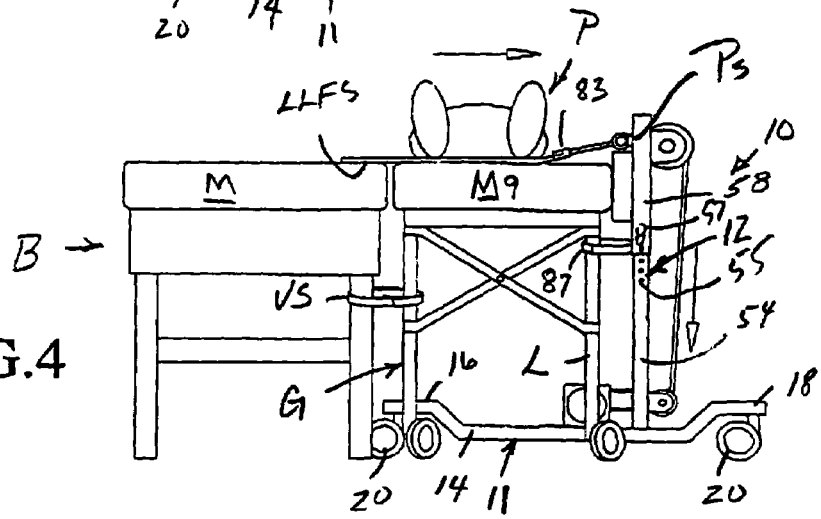
FIG. 4 is a side elevational view, and illustrates the slide sheet with a patient thereon being transferred from the bed to the gurney through appropriate energization of the electric motor and the various components associated therewith including the lower pair of driven pulleys, the cables connected thereto, the upper idler pulleys, the transfer bar and the slide sheet clamps.

In order to transfer the patient from the gurney G to the bed B, the patient transfer mechanism 10 is merely rolled from the position shown in FIG. 2 to the left side thereof with the platform 11 beneath the bed B projecting toward the gurney G. The process just described with respect to FIGS. 2 through 4 is then repeated to transfer the patient P from the gurney G to the bed B.

Although a preferred embodiment of the invention has been specifically illustrated and described herein, it is to be understood that minor variations may be made in the apparatus without departing from the spirit and scope of the invention, as defined by the appended claims.

We claim:

1. A transfer device adapted to transfer an individual from a bed to an adjacent support surface or vice versa comprising a mobile unit defined by a base having a forward end and a rear end and an upstanding structure having lower and upper end portions respectively adjacent to and remote from said base rear end, means for movably supporting said base with said base forward end beneath a bed and an adjacent floor, a lower drive pulley and an upper idler pulley respectively substantially adjacent to and remote from said base rear end, said upper idler pulley being located at a height corresponding substantially to an upper surface of a bed from which an individual is to be transferred, means for rotating said lower drive pulley to wind thereupon an elongated flexible element at least partially entrained upon said upper idler pulley with a terminal end portion of said elongated element being disposed substantially horizontally above said base, a second lower drive pulley and a second upper idler pulley respectively substantially adjacent to and remote from said base rear end, a second flexible elongated element at least partially entrained upon said second upper idler pulley and being windable upon said second lower drive pulley upon the operation of said rotating means, said second elongated element having a terminal end portion disposed substantially horizontally above said base and in substantially side-by-side relationship to said first-mentioned terminal end portion, and means for releasably connecting said first-mentioned and second elongated element terminal end portions to a slide interposed between an individual and a bed or an adjacent support surface upon which an individual is reposed whereby upon operation of said rotating means the slide with an individual thereon is pulled substantially horizontally by both said first-mentioned and second elongated elements in a substantially horizontal direction from a bed to an associated adjacent support surface or vice versa.

2. The transfer device as defined in claim 1 wherein said rotating means includes a driven shaft connected to said lower drive pulleys, said rotating means is a reversing motor, and means for transmitting rotary drive motion of said reversing motor to said driven shaft.

3. The transfer device as defined in claim 1 wherein said rotating means includes a driven shaft connected to said lower drive pulleys, said rotating means is a reversing motor, means for transmitting rotary drive motion of said reversing motor to said driven shaft in a direction of rotation to wind said elongated elements upon their lower drive pulleys, and slip clutch means for effecting opposite rotation of said lower drive pulleys when said rotating means is inoperative to unwind said elongated elements from said lower drive pulleys by manually pulling said elongated elements to effect opposite rotation of said lower drive pulleys.

4. The transfer device as defined in claim 1 wherein said base includes a substantially horizontal platform, and said rotating means is carried by said platform.

5. The transfer device as defined in claim 1 wherein said first-mentioned and second lower drive pulleys are carried by a common shaft.

6. The transfer device as defined in claim 1 including a pull bar, said first-mentioned and second elongated element terminal end portions are connected to said pull bar, and said releasably connecting means are connected to said pull bar.

7. The transfer device as defined in claim 1 wherein said upstanding structure includes a pair of upstanding spaced supports, and one of said upper idler pulleys is carried by an associated one of said upstanding supports.

8. The transfer device as defined in claim 1 wherein said base is defined by a pair of substantially parallel, transversely spaced, horizontally disposed supports; a platform bridging said horizontally disposed supports, said movable supporting means are wheels connected to said horizontally disposed supports, said upstanding structure includes a pair of upstanding spaced supports, and one of said upper idler pulleys is carried by an associated one of said upstanding supports.

9. The transfer device as defined in claim 5 wherein said base is substantially elongated and includes a relatively long forward end portion adapted to be located substantially entirely beneath a bed and a relatively short rear end portion, and said upstanding structure is located at said rear end portion.

10. The transfer device as defined in claim 5 wherein said rotating means includes a driven shaft connected to said lower drive pulleys, said rotating means is a reversing motor, means for transmitting rotary drive motion of said reversing motor to said driven shaft in a direction of rotation to wind said elongated elements upon their lower drive pulleys, and slip clutch means for effecting opposite rotation of said lower drive pulleys when said rotating means is inoperative to unwind said elongated elements from said lower drive pulleys by manually pulling said elongated elements to effect the opposite rotation of said lower drive pulleys.

11. The transfer device as defined in claim 5 wherein said upstanding structure includes a pair of upstanding spaced supports, and one of said upper idler pulleys is carried by an associated one of said upstanding supports.

12. The transfer device as defined in claim 6 wherein said base is substantially elongated and includes a relatively long forward end portion adapted to be located substantially entirely beneath a bed and a relatively short rear end portion, and said upstanding structure is located at said rear end portion.

13. The transfer device as defined in claim 6 wherein said rotating means includes a driven shaft connected to said lower drive pulleys, said rotating means is a reversing motor, means for transmitting rotary drive motion of said reversing motor to said driven shaft in a direction of rotation to wind said elongated elements upon said lower drive pulleys, and slip clutch means for effecting opposite rotation of said lower drive pulleys when said rotary rotating means is inoperative to unwind said elongated elements from said lower drive pulleys by manually pulling said elongated elements to effect the opposite rotation of said lower drive pulleys.

14. The transfer device as defined in claim 6 wherein said upstanding structure includes a pair of upstanding spaced supports, and one of said upper idler pulleys is carried by an associated one of said upstanding supports.

15. The transfer device as defined in claim 14 wherein said first-mentioned and second lower drive pulleys are carried by a common shaft.

* * * * *